United States Patent [19]

Ward et al.

[11] 3,982,809

[45] Sept. 28, 1976

[54] CORD ADAPTER

[75] Inventors: Ronald C. Ward; Richard B. Kosten, both of Huntsville, Ala.

[73] Assignee: GTE Automatic Electric Laboratories Incorporated, Northlake, Ill.

[22] Filed: Dec. 29, 1975

[21] Appl. No.: 644,981

[52] U.S. Cl. ..... 339/91 R; 339/103 R; 339/198 J; 339/256 SP

[51] Int. Cl.[2] ..... H01R 7/28; H01R 13/10

[58] Field of Search ..... 339/49 R, 75 R, 75 M, 339/91 R, 103 R, 105, 163, 176 MP, 176 P, 198 J, 256 SP, 258 S

[56] References Cited

UNITED STATES PATENTS

| | | | |
|---|---|---|---|
| 3,369,214 | 2/1968 | Krumreich et al. | 339/91 R X |
| 3,675,183 | 7/1972 | Drake | 339/103 R |
| 3,825,882 | 7/1974 | Tucker | 339/91 R X |
| 3,866,996 | 2/1975 | Elkins | 339/258 S X |

*Primary Examiner*—Granville Y. Custer, Jr.
*Assistant Examiner*—E. F. Desmond
*Attorney, Agent, or Firm*—Robert J. Black

[57] ABSTRACT

A cord adapter for retrofitting or adapting a conventional telephone line cord for use with a miniature plug and jack assembly, the cord adapter being of a construction such that no tools are required to install it.

The cord adapter will accommodate from one to six conductors and requires only that the spade terminals on the conductors be bent into a U-shaped configuration prior to installation into the plug portion of the adapter. A slot is molded into the plug body for retaining the line cord holder, which slot also functions as a bending fixture for bending the spade terminals on the ends of the conductors of the line cord. A plastic cover is provided for covering and retaining the connections. The cover furthermore helps retain the telephone line cord. The construction of the plug portion of the cord adapter and the cover is such that the cover can be attached to the plug portion without the need of any tools.

11 Claims, 9 Drawing Figures

CORD ADAPTER

BACKGROUND OF THE INVENTION

This invention relates, generally, to an improved cord adapter and, more particularly, it relates to a cord adapter for retrofitting a conventional telephone cord to a miniature plug and jack assembly.

Recently, a need has arisen for a cord adapter to retrofit a conventional telephone line cord for use with a miniature plug jack assembly, such as used, for example, in the Phone Mart system. Such a cord adapter for use in similar systems is disclosed in U.S. Pat. No. 3,825,882. The cord adapter of the present invention is of this type, however, various improvements are provided, all as set forth more specifically below.

SUMMARY OF THE INVENTION

The present invention provides a cord adapter for retrofitting or adapting a conventional telephone line cord for use with a miniature plug and jack assembly, the cord adapter being of a construction such that no tools are required to install it.

The cord adapter installs at the wall end of an existing telephone line cord which eliminates the problem of opening the telephone set and replacing the cord with a spiral Phone Mart cord. The cord adapter will accommodate from one to six conductors and requires only that the spade terminals be bent into a U-shaped configuration prior to installation into the plug portion of the adapter. A slot is molded into the plug body for retaining the line cord holder, which slot also functions as a bending fixture for bending the spade terminals on the ends of the conductors of the line cord.

The plug portion of the cord adapter is a molded plastic part that has six L-shaped metal terminals that are held in place by an interface fit. One end of the L-shaped terminal projects through molded slots at the front of the plug portion of the cord adapter and makes contact with the wire terminals of the Phone Mart jack. The other end of the terminals fit into slots at the back of the plug portion and makes contact with the line cord spade terminals. The plug portion has a molded latch arm for latching the cord adapter with its mating jack. A plastic cover is provided for covering and retaining the connections. The cover furthermore helps retain the telephone line cord. The construction of the plug portion of the cord adapter and the cover is such that the cover can be attached to the plug portion without the need of any tools.

Accordingly, it is an object of the present invention to provide an improved cord adapter and, particularly, a cord adapter for retrofitting a conventional telephone line cord for use with a miniature plug and jack assembly.

Other objects, features and advantages of the present invention will become more apparent from the following description, appended claims and drawings.

DESCRIPTION OF THE PREFERRED EMBODIMENT

Figure 1:
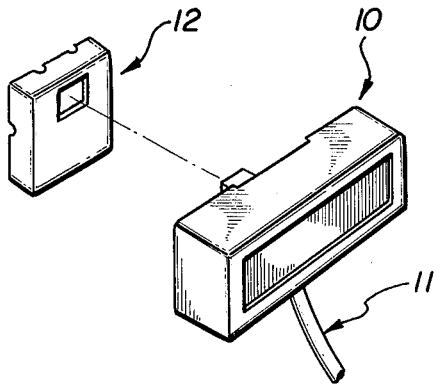
FIG. 1 is a perspective view generally illustrating a cord adapter exemplary of the present invention, for retrofitting a conventional telephone line cord for use with a miniature jack.

Referring now to the drawings, in FIG. 1 there is illustrated a cord adapter 10 exemplary of the present invention, for retrofitting a conventional telephone line cord 11 for use with a miniature wall jack, such as the wall jack 12. As can be best seen in FIG. 2, the cord adapter 10 includes a cover 14 and a plug 15.

The plug 15 is molded of plastic and, as can be best seen in FIGS. 2 and 4–7, it includes a back plate 16 which is generally rectangular shaped and has a miniature plug 17 integrally formed with and extending laterally outwardly from its one side and a terminal block 18 which is likewise integrally molded with it and extends laterally outwardly on the opposite side of the back plate. The terminal block 18, as can be best seen in FIGS. 2 and 4, has a generally smaller surface area than the back plate 16, and has an end wall 19 which extends across the entire width of the back plate 16. However, it will be apparent from the description below, that the back plate 16 and the terminal block 18 could be coextensive in area.

The terminal block 18 includes a plurality of terminal cavities 21, six in number in the illustrated embodiment, and these terminal cavities 21 are of a generally T-shaped construction to provide a synergetic effect to guide the spade terminals on the ends of the line conductors of the telephone line cord into position, to maintain electrical connection (by confiniing the spring tension in a restricted space), to provide an insulated pocket for the spade terminal, and to provide an electrical connecting means that allows connecting one spade terminal bent into a U-shape or two terminals, as required for bridged ringing, as more fully described below. Within each of the terminal cavities 21, there is disposed an L-shaped contact 22 which, as can be best seen in FIGS. 4, 6 and 7, has one leg thereof which extends from a terminal cavity 21 and is bent to be disposed and slidably retained between various ones of a number of support dividers 23 which are integrally molded with the plug 15 so as to separate and position these contacts 22. The other leg of the L-shaped contacts 22 extend through the terminal block 18 and the back plate 16 into the miniature plug 17. These contacts 22 are disposed within spaced apart slots in the miniature plug 17 and are exposed so that contact can be made with the wire terminals of the jack with which it mates.

Alignment grooves 24 and 25 are formed in one edge of the plug 15, in spaced apart relationship. On the opposite side edge of the plug 15, there are provided alignment ribs 26 and 27. The alignment grooves 24 and 25 cooperate with alignment ribs 55 and 56 formed on the interior of the cover 14, while the alignment ribs 26 and 27 cooperate with alignment slots or grooves 57 and 58 formed in the cover 14, to assist in affixing the cover to the plug 15, all as more fully described below. The plug 15 also has a retaining slot 29 formed in it substantially centrally located between its edge side walls and extending through the end wall 19. Locking means 30 in the form of a projection disposed to extend into the retaining slot 29 is provided to help retain the cord holder on the end of the telephone line cord 11 in the plug 15, as described below. The retaining slot 29 also functions as a bending fixture for bending the spade terminals on the ends of the conductors of the telephone line cord, so that these spade terminals can be bent without the need of any tool.

Figure 4:
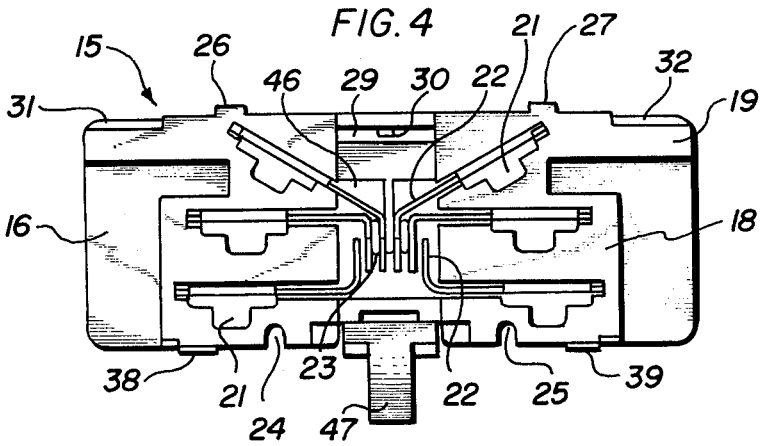
FIG. 4 is a bottom plan view of the plug of the cord adapter.
Figure 5:
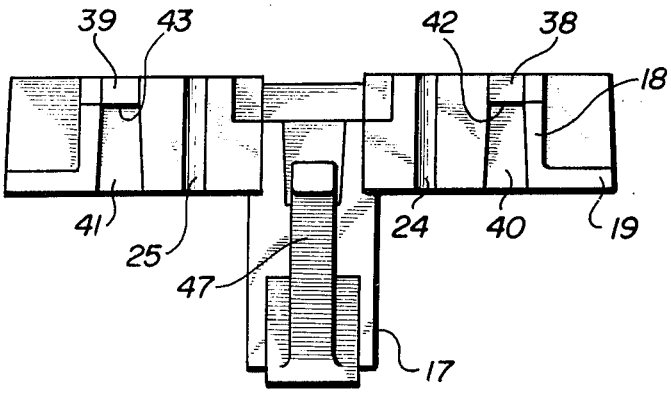
FIG. 5 is a side plan view of the plug of the cord adapter.
Figure 6:
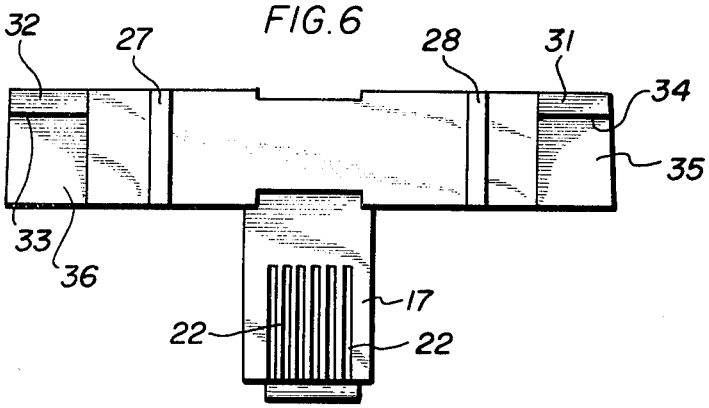
FIG. 6 is a side plan view of the plug of the cord adapter.
Figure 7:
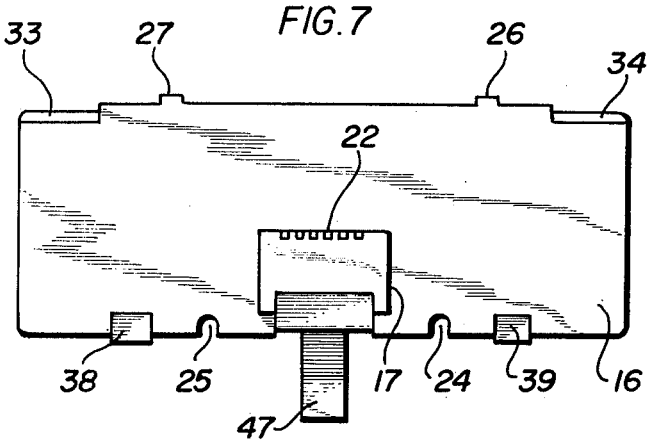
FIG. 7 is a bottom plan view of the plug of the cord adapter.

A pair of tapered cam surfaces 31 and 32 are formed on the corner edge of the end wall 19 in spaced apart relationship at each of the opposite corners of the plug 15, as can be best seen in FIGS. 4 and 6. A pair of cooperating recessed cutouts 35 and 36 merge with the tapered cam surfaces 31 and 32 so as to provide stepped shoulders 33 and 34 which function as locks which function with locking notches 63 formed in the cover 14, as described below. There are also provided a pair of spaced apart cam surfaces 38 and 39 on the opposite edge of the plug 15, and these cam surfaces 38 and 39 likewise merge with grooves 40 and 41 formed in the side edge of the plug 15 to provide shoulders 42 and 43 which function as locks which cooperate with the locking notches 63 formed in the cover 14, to secure the cover to the plug 15. A recess 46 is formed in the terminal block 18 of the plug 15, and merges with the retaining slot 29 formed therein. This recess 46 receives the end of the telephone line cord to secure the latter with the plug 15. A spring latch 47 is integrally molded on the end of the miniature plug 17 for releasably locking the cord adapter 10 in the wall jack 12.

Figure 9:
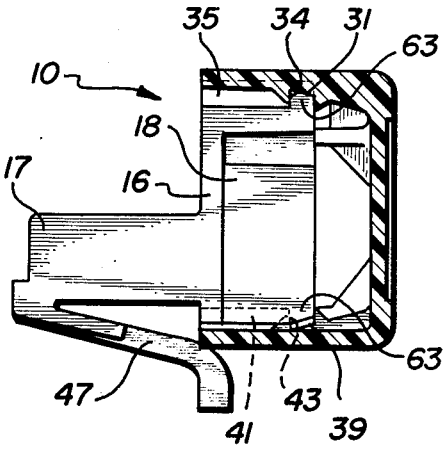
FIG. 9 is an end plan view of the plug of the cord adapter, with the cover affixed to it, the cover being sectionalized to illustrate the manner in which the plug is releasably locked within the cover.
Figure 8:
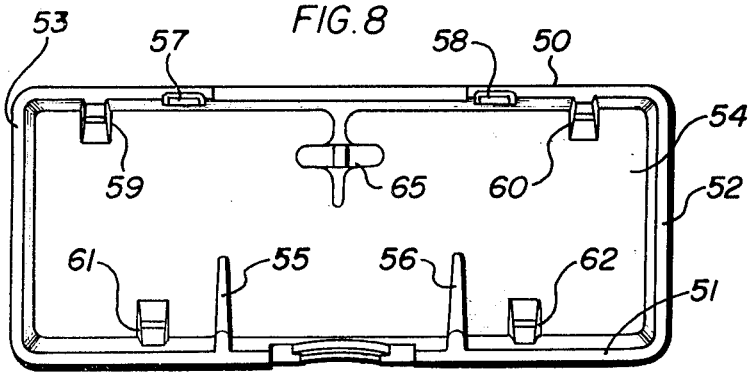
FIG. 8 is a bottom plan view of the cover of the cord adapter.

The cover 14 is generally rectangular shaped having side walls 50–53 and bottom wall 54, all of which are proportioned to receive the terminal block 18 and the back plate 16 of the plug 15 therein, with only the miniature plug 17 extending therefrom, as can be best seen in FIG. 9. The cover 14 like the plug 15 preferably is molded of plastic and, when affixed to the plug 15, functions to cover the connections and to retain the spade terminals in the line cord secured within the terminal block 18.

As indicated above, alignment ribs 55 and 56 are formed on one of the side walls, side wall 51 as illustrated, and these alignment ribs 55 and 56 cooperate with correspondingly formed and positioned alignment grooves 24 and 25 in the side edge of the plug 15 to assist in aligning and guiding the plug 15 into the cover 14. The cover 14 also has alignment slots or grooves 57 and 58 formed in the side wall 50 thereof which cooperate with the alignment ribs 26 and 27 formed on the opposite side edge of the plug 15 to assist in aligning and guiding the plug 15 into the cover 14.

Further still, the cover 14 has two locking guide ribs 59 and 60 formed on its side wall 50 and two locking guide ribs 61 and 62 formed on its side wall 51. These locking guide ribs 59–62 each have a locking notch 63 formed in it. These locking guide ribs 59–62 and the locking notches 63 therein are positioned and arranged to lockingly receive and retain therein the shoulders

33, 34, 42 and 43 formed on the plug 15 to releasably lock the cover 14 to the plug 15. Since the cover 14 is of a plastic material and is somewhat flexible, the cover 14 after being affixed to the plug 15 can be removed by outwardly flexing the side walls 50 and 51 to disengage the shoulders 33, 34, 42 and 43 and the locking notches 63.

An upstanding projection 65 is integrally formed on the bottom wall 54 of the cover 14. This upstanding projection 65 is generally triangular shaped, as can be best seen in FIG. 2, and functions to assist in retaining the end of the line cord and more specifically and cord holder on the end thereof within the retaining slot 29 in the plug 15, as more fully described below. A cutout 66 is provided in the side wall 51 of the cover 14, for receiving therethrough the line cord 11.

Figure 3:
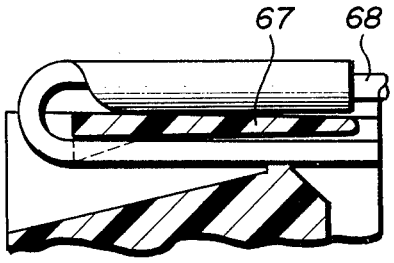
FIG. 3 is a partial sectional view illustrating the manner in which the plug of the cord adapter is constructed to provide a bending fixture for the spade terminals of the telephone line cord.
Figure 2:
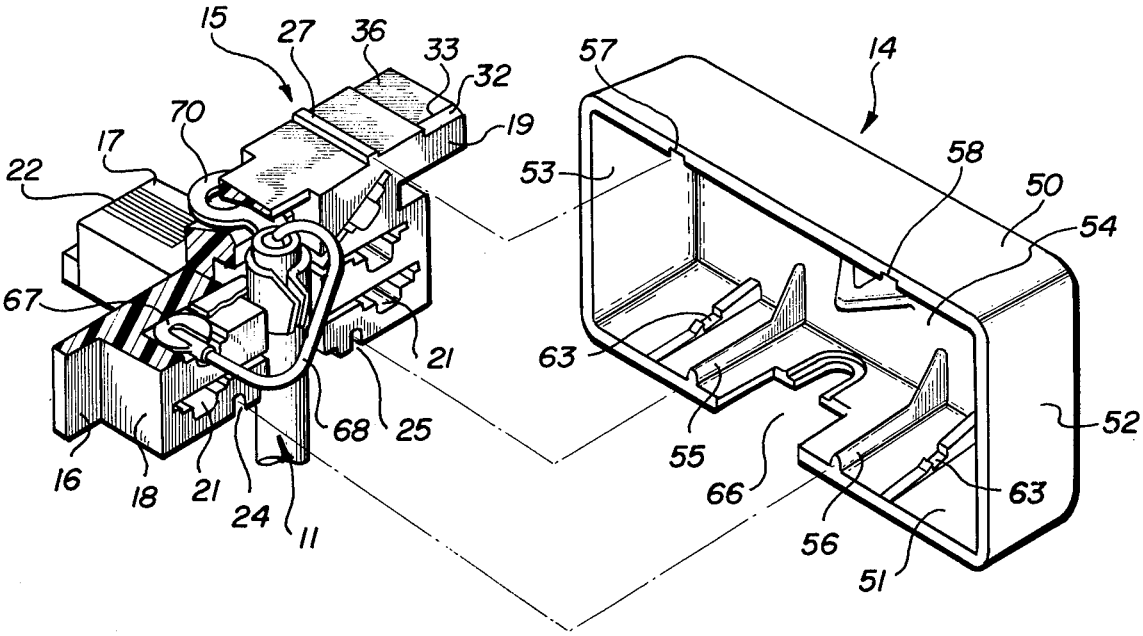
FIG. 2 is an exploded perspective view of a cord adapter exemplary of the present invention.

To retrofit the telephone line cord for use with a miniature wall jack, such as the wall jack 12, each of the spade terminals on the ends of the conductors, such as the spade terminal 67 on the end of the conductor 68, illustrated in FIGS. 2 and 3, is bent into a U-shaped configuration in the range of 160° to 180° prior to installation into the terminal cavities 21 in the terminal block 18 of the plug 15. As indicated above, and as can be seen in FIG. 3, the retaining slot 29 forms a bending fixture for bending these spade terminals 67. To bend the spade terminals, the spade portion thereof is simply inserted into the retaining slot 29, as generally illustrated in FIG. 3, and then the terminal portion thereof simply is reversely bent into a U-shape. In this manner, the spade terminals can be formed into a U-shaped configuration, without the need of any tools. Correspondingly, the cord holder 70 normally provided on the end of the line cord (FIG. 2) is bent at a 90° angle, again using the retaining slot 29 in generally the same fashion as described above with respect to the spade terminals.

The spade terminals 67 then are fitted into the terminal cavities 21 in the terminal block 18 of the plug 15 as generally illustrated in FIG. 2 where only one of the number of line conductors of the line cord is shown. In doing so, the spade terminals 67 each forms its own spring force to maintain contact with the contact 22 in the terminal cavities 21. The terminal cavities 21 being T-shaped recesses provide a synergetic effect to guide the spade terminals 67 into position, to maintain electrical connection by confining the spring tension in a restricted space, to provide an insulated pocket for the spade terminals 67, and to provide an electrical connecting means that allows connecting one spade terminal 67 bent into a U-shape or two terminals as required for bridge ringing.

The line cord is anchored in the plug 15, by disposing the line cord in the recess 46 formed in the terminal block 18 and by extending the cord holder 70 through the retaining slot 29, as illustrated in FIG. 2. The locking means 30 in the form of a projection extending downwardly into the retaining slot 29 extends through the aperture formed in the cord holder to capture the cord holder in the retaining slot 29. As is conventional, the conductors of the line cord 11 are color-coded, and indicia can be provided on the terminal block adjacent each of the respective terminal cavities 21 indicating the appropriate terminal cavity into which the respective ones of the color-coded line conductors is to be inserted.

After having installed the line cord in the plug 15, in the manner described above, the cover 14 now can be affixed to the plug 15. In this respect, the cover 14 can be attached to the plug 15 without the need of any tools. More particularly, the cover 14 is affixed to the plug 15 by simply aligning the alignment ribs 55 and 56 on the side wall 51 of the cover 14 with the alignment grooves 24 and 25 formed in the plug 15, and the alignment slots or grooves 57 and 58 on the side walls 50 of the cover 14 with the alignment ribs 26 and 27 formed on the plug 15, to align and to guide the cover 14 onto the plug 15. Once aligned, the cover 14 is simply forcibly urged onto the plug 15, and in the course of doing so, the tapered cam surfaces 31 and 32 slidably engage with the locking guide ribs 59 and 60 on the side wall 50 of the cover 14, and the cam surfaces 38 and 39 on the plug 15 slidably engage with the locking guide ribs 61 and 62 on the side wall 51 of the cover 14. The locking guide ribs 59–62, being tapered upwardly as they extend toward the bottom wall 54 of the cover 14, and the cam surfaces 31, 32, 38 and 39 all function to generally forcibly urge the side walls 50 and 51 to flex outwardly sufficiently to subsequently cause the side walls 50 and 51 to flex inwardly to lockingly engage with the shoulders 33, 34, 42 and 43, within the locking notches 63, as can be best seen in FIG. 9. With the edges of the locking notches 63 engaged with the shoulders 33, 34, 42 and 43, the cover is effectively removably secured to the plug 15. The line cord 11 extends out of the cover 14, through the cutout 66 provided in the side wall 51 thereof. The upstanding projection 65 engages the end of the line cord 11 and assists in retaining the cord holder within the retaining slot 29 and hence in retaining the line cord within the plug 15.

To remove the cover 14 from the plug 15, the side walls 50 and 51 are simply flexibly urged outwardly sufficiently to disengage the locking notches 63 with the shoulders 33, 34, 42 and 43 on the plug 15. This can be accomplished simply using the fingers, so that again no tools are required for removing the cover 14 from the plug 15.

It will thus be seen that the objects set forth above, among those made apparent from the preceding description, are efficiently attained and certain changes may be made in the above article. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. A cord adapter for use with a telephone line cord including a plurality of conductors for making electrical connections between the conductors of the line cord and electrically conductive contacts of the cord adapter, the line cord having a cord holder on the end thereof and each of the conductors having a spade terminal on the end thereof, said cord adapter comprising: a plug molded of a non-conductive material, a removable snap-on cover for said plug molded of a non-conductive material, said plug comprising: a miniature terminal plug and terminal block which are integrally formed, said terminal block having formed therein a plurality of terminal cavities, each of which is proportioned to receive therein at least one of said spade terminals on the ends of said conductors of said line cord, an electrical contact disposed within the respective ones of said terminal cavities and extended into said miniature terminal plug such that other electrical connections can be established with said electrical contacts, cooperative locking means integrally formed on said plug, said cover comprising: a bottom wall and four side walls all proportioned to receive therein said plug with only said miniature terminal plug extending therefrom, cooperative locking means formed on ones of said side walls for mating engagement with said locking means on said plug, said locking means on said side walls and on said plug being releasably lockingly engaged to secure said cover with said plug when said cover is forcibly urged over said plug, whereby said spade terminals can be disposed within said terminal cavities in said terminal block in said plug and said cover affixed to said plug without the need of any tools.

2. The cord adapter of claim 1, wherein said plug further comprises at least a pair of spaced-apart alignment grooves formed in one side end thereof, and at least a pair of spaced-apart alignment ribs formed on an opposite side end thereof, said cover having formed on one side wall thereof a pair of alignment ribs disposed to slidably engage within said alignment grooves and having formed on an opposite side wall thereof a pair of alignment slots disposed to slidably receive therein said alignment ribs, for aligning and guiding said cover over said plug during assembly of said cover and said plug.

3. The cord adapter of claim 1, wherein said cooperative locking means formed on said side walls of said cover comprise a pair of spaced-apart locking guide ribs formed on each of two opposite side walls of said cover, each of said locking guide ribs being sloped to form a cam surface and having a locking notch therein, said cooperative locking means on said plug comprise recessed areas in the side edges of said plug which form locking shoulders, each of said locking shoulders being proportioned and positioned to lockingly engage within one of said locking notches in the respective ones of said locking guide ribs when said cover is forcibly urged over said plug, said side walls of said cover being flexed outwardly as said plug is slidably urged into said cover by said cam surfaces and said locking shoulders and said locking notches being snap-actingly engaged when positionally aligned.

4. The cord adapter of claim 3, further comprising a cam surface cooperatively positioned with each of said locking surfaces and cooperating with said cam surfaces on said locking guide ribs to assist in assembling said cover and said plug.

5. The cord adapter of claim 4, wherein said plug further comprises at least a pair of spaced-apart alignment grooves formed in one side end thereof, and at least a pair of spaced-apart alignment ribs formed on an opposite side end thereof, said cover having formed on one side wall thereof a pair of alignment ribs disposed to slidably engage within said alignment grooves and having formed on an opposite side wall thereof a pair of alignment slots disposed to slidably receive therein said alignment ribs, for aligning and guiding said cover over said plug during assembly of said cover and said plug.

6. The cord adapter of claim 3, wherein said terminal cavities each is generally T-shaped and proportioned to receive therein two of said spade terminals on the end of said conductors.

7. The cord adapter of claim 3, wherein said spade terminals are bent U-shaped within a range of 160° to 180° being installed in said terminal cavities, each of said terminal cavities being a T-shaped recess proportioned to guide said U-shaped spade terminals into them and to maintain electrical connection between said spade terminals and the electrical contacts disposed within said terminal cavities by confining the spring tension of the U-shaped spade terminals in a restricted space, said T-shaped recesses further providing insulated pockets for said spade terminals.

8. The cord adapter of claim 7, wherein said plug further comprises a recessed cavity for receiving the end of said line cord and a retaining slot at one end of said recessed cavity for receiving the cord holder on the end of said line cord for anchoring the line cord in said plug, said cord holder being bend 90° before being inserted within said retaining slot, whereby said line cord can be disposed within said recessed cavity and said cord holder extended into said retaining slot.

9. The cord adapter of claim 8, further comprising locking means in the form of a projection integrally molded with said plug and extending into said retaining slot for said cord holder, said projection engaging within an aperture in said cord holder to assist in capturing said cord holder in said retaining slot.

10. The cord adapter of claim 9, wherein said retaining slot further is proportioned and positioned to provide the further function of a bending fixture for bending said spade terminals and said cord holder, whereby no tools are required for bending them for installation.

11. The cord adapter of claim 10, further comprising a flexible latch arm integrally molded with said plug for positively latching said cord adapter in a mating jack.

* * * * *

UNITED STATES PATENT AND TRADEMARK OFFICE

CERTIFICATE OF CORRECTION

PATENT NO. : 3,982,809

DATED : September 28, 1976

INVENTOR(S) : R.C. WARD/R.G. KOSTEN

It is certified that error appears in the above-identified patent and that said Letters Patent are hereby corrected as shown below:

Column 7, line 12, "bend" should be --bent--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*